United States Patent [19]

Hänsch

[11] Patent Number: 4,901,993

[45] Date of Patent: Feb. 20, 1990

[54] METHOD OF PRODUCING A MULTI-SHEET FOLDED PRINTED PRODUCT

[75] Inventor: Egon Hänsch, Wetzikon, Switzerland

[73] Assignee: Ferag AG, Hinwil, Switzerland

[21] Appl. No.: 322,295

[22] Filed: Mar. 13, 1989

Related U.S. Application Data

[60] Continuation of Ser. No. 929,907, Nov. 13, 1986, abandoned, which is a division of Ser. No. 555,688, Nov. 28, 1983.

[30] Foreign Application Priority Data

Dec. 13, 1982 [CH] Switzerland ..... 7251/82

[51] Int. Cl.[4] ..... B41F 13/56

[52] U.S. Cl. ..... 270/21.1; 493/324; 493/356; 493/346

[58] Field of Search ..... 270/5, 7, 8, 21.1, 54; 101/224, 226, 227; 493/346, 363, 356, 324; 283/36, 64

[56] References Cited

U.S. PATENT DOCUMENTS

| | | | |
|---|---|---|---|
| 556,409 | 3/1896 | Firm | 270/8 |
| 637,330 | 11/1899 | Firm | 270/8 |
| 658,209 | 9/1900 | Firm | 270/8 |
| 1,171,093 | 2/1916 | Cottrell | 270/21.1 |
| 1,685,140 | 9/1928 | Rosenthal et al. | 493/324 |
| 2,169,932 | 8/1939 | Sweet et al. . | |
| 2,214,593 | 9/1940 | Mustin et al. | 493/346 |
| 2,361,140 | 10/1944 | Wolf | 220/5 |
| 2,474,775 | 6/1949 | Borchers | 493/363 |
| 2,631,845 | 3/1953 | Zuckerman | 270/21.1 |
| 2,788,208 | 4/1957 | Pearce | 493/324 |
| 3,275,316 | 9/1966 | Cleary, Jr. . | |
| 3,697,061 | 10/1972 | Levine et al. | 270/5 |
| 3,866,900 | 2/1975 | Kebba | 270/5 |
| 4,046,366 | 9/1977 | McCain et al. | 270/54 |
| 4,089,514 | 5/1978 | Skipworth | 270/5 |
| 4,176,862 | 12/1979 | Targe . | |
| 4,279,409 | 7/1981 | Pemberton | 270/8 |
| 4,523,775 | 6/1985 | Reist . | |
| 4,754,959 | 7/1988 | Kobler et al. | 493/324 |
| 4,812,195 | 3/1989 | Vijuk | 493/356 |

FOREIGN PATENT DOCUMENTS

| | | |
|---|---|---|
| 0068228 | 1/1983 | European Pat. Off. . |
| 1122139 | 9/1956 | France . |
| 2077235 | 12/1981 | United Kingdom . |

*Primary Examiner*—Eugene H. Eickholt

*Attorney, Agent, or Firm*—Fleit, Jacobson, Cohn, Price, Holman & Stern

[57] ABSTRACT

To readily open up a multi-sheet folded printed product comprising at least two folded printed sheets or signatures which are placed one inside the other, there is provided an innermost printed sheet which is, for instance, of greater length at the center in the direction of the fold line than the remaining printed sheets. The innermost printed sheet thus protrudes past the remaining printed sheets by a marginal section or lap at one lateral edge. An opening device now can engage the protruding marginal section and can open up the printed product at the center without difficulties. When the printed product has been completed, i.e. after insertion of an enclosure or inserts into the opened printed product, the marginal section or lap is cut away. Since such marginal section or lap must be cut away only at one printed sheet the loss in material associated with the cutting operation is exceedingly small. A further possibility, without the need to cut away any marginal lap, is to use printed sheets of the same size but the the innermost printed sheet laid in offset protruding relation to the remaining printed sheets, and following completion of the printed product to simply square up the innermost printed sheet again with the remaining printed sheets.

16 Claims, 5 Drawing Sheets

FIG. 9
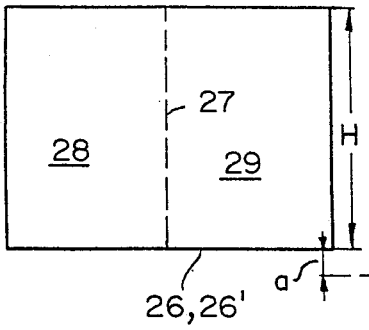
FIG. 10
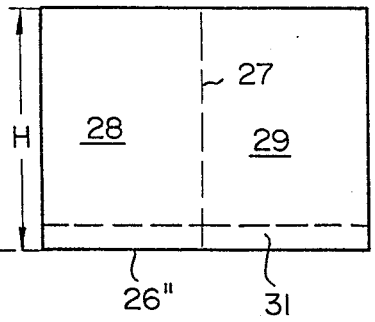
FIG. 11
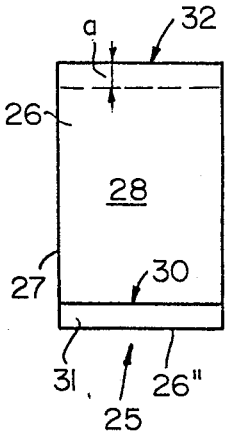
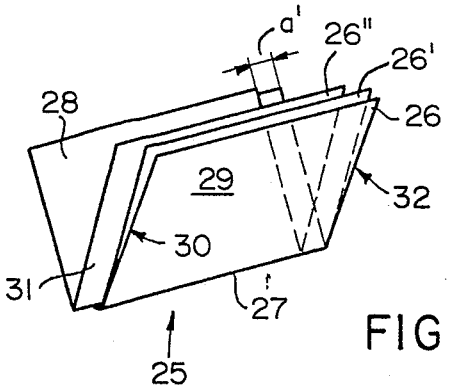
FIG. 12

FIG. 14
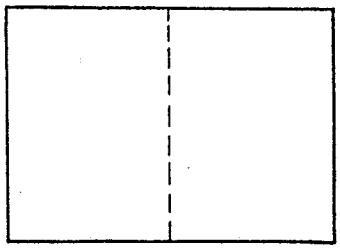
FIG. 15
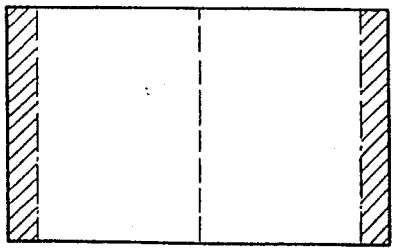
FIG. 16
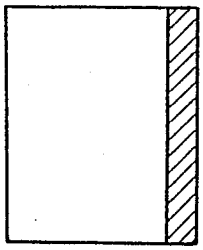
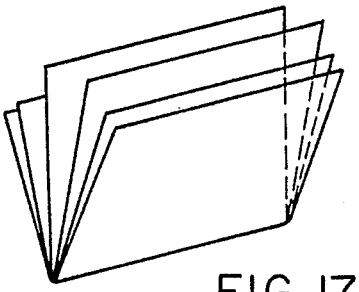
FIG. 17
FIG. 18
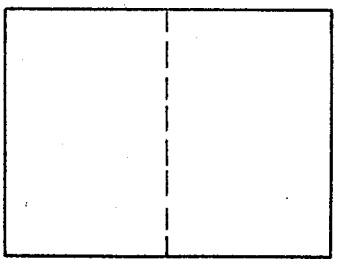
FIG. 19
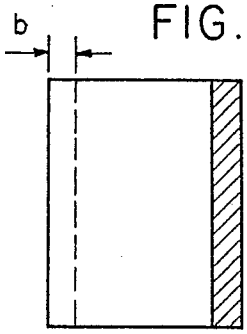
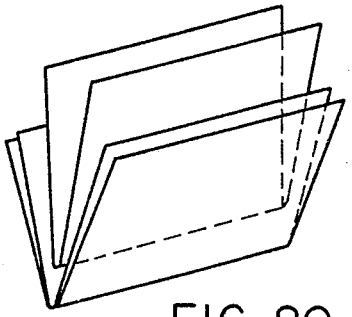
FIG. 20

METHOD OF PRODUCING A MULTI-SHEET FOLDED PRINTED PRODUCT

CROSS-REFERENCE TO RELATED PATENT AND APPLICATIONS

This application is a continuation of Ser. No. 06/929,907, filed Nov. 13, 1986, now abandoned which is a divisional application of my commonly assigned, copending U.S. application Ser. No. 06/555,688, filed Nov. 28, 1983, and entitled "Multi-Sheet Folded Printed Product and Method of Producing the Same".

This application is related to the commonly assigned, copending U.S. application Ser. No. 390,505, filed June 21, 1982, entitled "Folded Sheet or Printed Sheet Intended to Be Folded and Method and Apparatus for Fabrication Thereof", now U.S. Pat. No. 4,523,775, granted June 18, 1985.

BACKGROUND OF THE INVENTION

The present invention relates to a new and improved multi-sheet folded printed product and a method of producing the same.

While the description to follow, as a matter of convenience, generally refers to printed products and methods of producing the same, obviously other types of products can be conveniently handled, and therefore, the use of this term is not to be construed in a limiting sense in any way whatsoever, but merely is to be viewed as an exemplary and desirable field of application for the inventive measures.

In its more particular aspects, the present invention relates specifically to a new and improved multi-sheet folded printed product comprising at least two folded printed sheets which are tucked or placed one inside the other, as well as to a method of producing the same.

Very frequently it is required to open up multi-sheet printed products such as, for example, newspapers, journals, magazines and the like composed of folded printed sheets or signatures placed one inside the other, at the center in order to introduce enclosures. For this purpose it is known to fold the printed sheets outside or eccentric to their center line so that a protruding section, a so-called pre-fold, is formed at a side edge extending parallel to the center fold or spine fold line and which has a constant width over the entire length of the side or lateral edge of the printed product. By engaging the protruding sections the printed product comprising such printed sheets or signatures can be readily or easily opened up at the center. After the insertion of the inserts into the printed product in the opened-up state thereof these protruding sections are then cut away as waste. Even if such a protruding section which is to be cut away is not very wide and measures only about 8 mm, a nevertheless quite considerable loss in paper material results, considering the very large number of processed printed sheets or signatures. Such loss will be reflected in corresponding costs of the processing operation.

SUMMARY OF THE INVENTION

Therefore, with the foregoing in mind it is a primary object of the present invention to provide a new and improved method of producing a printed product which can be reliably opened up at the center or central region thereof in a simple manner without significant additional costs resulting from the measures required therefor.

Another important object of the present invention is directed to the provision of a new and improved method for producing a printed product which can be reliably opened up at the center or central region thereof in a simple manner without significant additional costs, for example, due to large losses in paper material.

Still a further significant object of the present invention is directed to the provision of a new and improved method of producing a printed product which can be reliably opened up at the center or central region thereof in a simple manner without any impairment in the appearance of the final printed product resulting from the measures required therefor.

The printed product of the present development is manifested by the features that, the innermost printed sheet protrudes past or beyond the remaining printed sheets at one side or lateral edge thereof.

The innermost printed sheet thus defines a marginal section or lap which protrudes past or beyond the remaining printed sheets and permits the product to be opened at the center without any great difficulties. The protruding marginal section or lap can be obtained, for example, by designing the innermost printed sheet so as to possess a greater dimension than the remaining printed sheets either in a direction in which the center fold or spine fold line extends or in a direction extending transversely thereto. The protruding marginal section is cut away or trimmed off at the end or termination of the processing operation. The loss in paper material associated with this cutting operation is significantly less than in the case of the aforementioned conventional product and processing technique in which a marginal section or lap has to be cut away not only from one printed sheet but from half of the total number of printed sheets forming the printed product.

However, it is also possible according to the invention to use printed sheets which all have the same or essentially the same dimensions and to ensure that upon assembling or collating the printed sheets the innermost printed sheet laterally protrudes past or beyond the remaining printed sheets. At the end of the operation the innermost printed sheet can be again pushed back or displaced such that the side or lateral edges thereof are aligned with the side edges of the remaining printed sheets. There will not arise any loss in paper material with such an embodiment of the invention.

As alluded to above, the invention is not only concerned with the aforementioned product aspects, but also relates to a novel method of producing the same. Generally speaking, the inventive method comprises the steps of producing a printed product which comprises at least two folded printed sheets or signatures tucked or placed one inside the other, wherein the innermost printed sheet protrudes past or beyond the remaining printed sheets at one side or lateral edge thereof.

To achieve the aforementioned measures the inventive method of producing a multi-sheet folded printed product, in its more specific aspects, comprises:

forming at least two printed strands or webs or continuous preliminary product lines such that each one of said printed strands or webs defines a predetermined longitudinal edge thereof;

superposing said at least two printed strands or webs such that one printed strand or web provided with information intended for an innermost printed sheet in the final printed product is positioned such that the longitudinal edge thereof laterally protrudes past or beyond the remaining strand;

cutting or severing said superposed at least two printed strands or webs in a direction extending transversely, preferably at right angles, relative to said longitudinal edges thereof in order to form individual printed sheets; and conjointly folding said superposed printed sheets such that said printed sheet formed from said one printed strand or web forms said innermost printed sheet.

The method of producing the aforementioned multi-sheet folded printed products as described hereinbefore enables the inventive printed products to be produced by means of rotary printing presses which require only insubstantial modifications as compared to presently used printing presses.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIGS. 9 and 10 each show a top plan view of printed sheets or signatures in an opened-up and offset state;

FIG. 11 is a top plan view of a second embodiment of the printed product according to the invention formed from the printed sheets as shown in FIGS. 9 and 10 in a folded state in which the printed sheets are placed or tucked one inside the other;

FIG. 12 is a perspective view of the printed product shown in FIG. 11 in a half-opened state;

FIGS. 14 and 15 show a top plan view of printed sheets or signatures having different widths in an opened-up state thereof;

FIG. 16 is a top plan view of a third embodiment of the printed product according to the invention, formed from the printed sheets shown in FIGS. 14 and 15 in a folded state thereof, in which the printed sheets are tucked or placed one inside the other;

FIG. 17 is a perspective view of the printed product shown in FIG. 16 in a half-open state;

FIG. 18 shows a top plan view of a printed sheet or signature in an opened-up state;

FIG. 19 is a top plan view of a fourth embodiment of the printed product according to the invention formed from printed sheets as shown in FIG. 18 in a folded state in which the printed sheets are placed or tucked one inside the other in an offset state; and FIG. 20 is a perspective view of the printed product shown in FIG. 19 in a half-opened state.

DETAILED DESCRIPTION OF THE PREFERRED EMBODIMENTS

Figure 1:
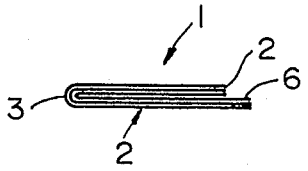
FIG. 1 (PRIOR ART)
FIGS. 1 to 3 show a side view and top plan views of a prior art multi-sheet printed product in the folded state and in the opened-up state respectively.
Figure 2:
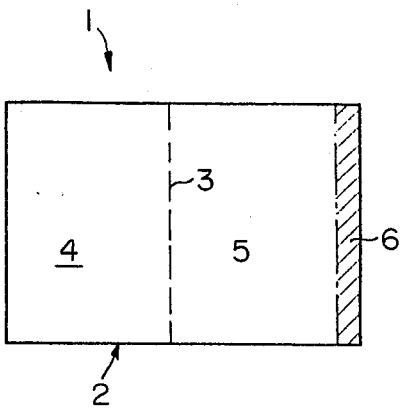
FIG. 2 (PRIOR ART)
Figure 3:
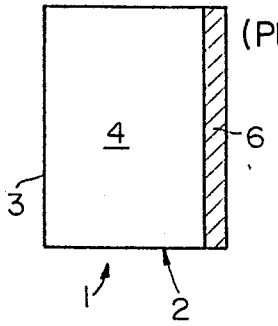
FIG. 3 (PRIOR ART)

Turning attention now specifically to FIGS. 1 to 3 there has been illustrated a prior art or conventional multi-sheet printed product 1 in its folded state in different views in FIGS. 1 and 2 and in an opened-up state in FIG. 3. In the structure as shown in such FIGS. 1 to 3, the printed product 1 comprises three printed sheets 2 which have been folded along an off-center or eccentric line 3 and tucked or placed one inside another. The fold line 3 separates the two pages or sheet portions 4 and 5. The right-hand page or sheet portion 5 of each printed sheet or signature 2 comprises a lateral margin which extends substantially parallel to the fold line 3 and defines a rectangularly-shaped marginal section or prefold 6 which protrudes beyond and extends with a constant width over the entire height of the right-hand page or sheet portion 5. Suitable opening devices for opening up the printed product 1 along the center line or fold 3 can engage with this protruding section or prefold 6 in conventional manner.

After the insertion of inserts or enclosures into the opened-up printed product 1, i.e., after completing the production of such printed product, the protruding sections or prefolds 6 are cut away or trimmed off and form waste material. Since a strip of material having the size of the protruding section or prefold 6 is trimmed off or cut away from all of the right-hand pages or sheet portions 5 in the printed product 1, the loss in paper material is quite considerable, especially in plants or business establishments producing a large volume of printed products 1.

A first embodiment of the printed product constructed according to the present invention is illustrated in FIGS. 4 to 7 and has been designated by reference numeral 7. This printed product 7 can be opened up along the center line or fold 9, i.e. its spine, without any difficulties, but with such inventive printed product 7 the loss in paper material is significantly less than when using the conventional or prior art printed product 1 illustrated in FIGS. 1 to 3.

Figure 4:
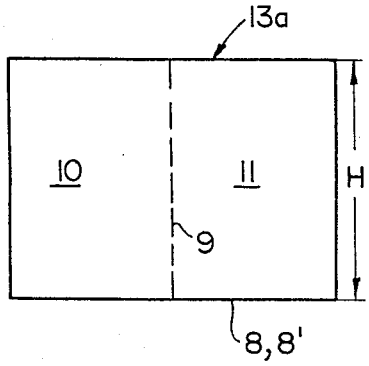
FIGS. 4 and 5 show a top plan view of printed sheets or signatures having different heights in an opened-up state thereof.
Figure 5:
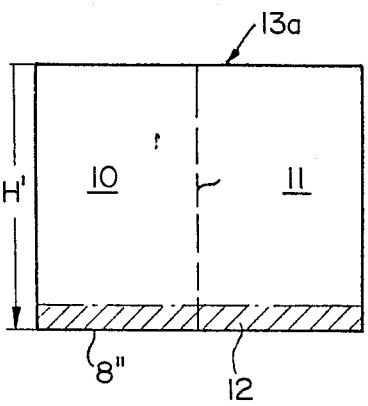
Figure 6:
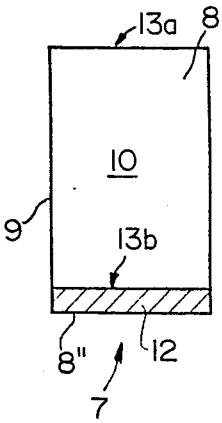
FIG. 6 is a top plan view of a first embodiment of the printed product according to the invention formed from the printed sheets shown in FIGS. 4 and 5 in a folded state thereof in which the printed sheets are tucked or placed one inside the other.

Such printed product 7 is formed, for instance, by three printed sheets 8, 8' and 8'' which are tucked or placed one inside another and all of which printed sheets 8, 8' and 8'' are folded along a center fold line or spine fold 9 at the center. The fold line 9 divides each printed sheet 8, 8' and 8'' so as to form two pages or sheet portions 10 and 11. The innermost printed sheet 8'' is dimensioned so as to be, i.e. taller, by a marginal section or lap 12 as measured in the direction of the fold line 9 and in comparison to the two remaining printed sheets 8 and 8'. The height of the printed sheets 8, 8' and 8'' has been conventionally designated by reference characters H and H', respectively, in FIGS. 4 and 5. In FIG. 4 the printed sheets 8 and 8' are shown in superposed position, while in FIG. 5 only the innermost printed sheet 8'' is shown. In the completed printed product 7 as depicted in FIG. 6 the innermost printed sheet 8'' is superposed on the two other printed sheets 8, 8' in such a manner that the top edges **13*a* of the three printed sheets 8, 8' and 8" are aligned. At the other bottom edge 13***b* which is located opposite to the top or upper edge 13*a* in the printed product 7, the innermost printed sheet 8" now protrudes past or beyond the two outer printed sheets 8 and 8' by the marginal section or lap 12 as will be particularly evident from FIGS. 6 and 7.

To open up the thus formed folded printed product 7 it is now possible, and without any difficulty, to engage the protruding marginal section or lap 12 by using any suitable product opening device such as, for example, suction devices or equivalent opening facilities. Since the marginal section or lap 12, as already mentioned, belongs to the innermost printed sheet 8", the printed product 7 is opened up precisely along the center thereof.

After completing the printed product 7, i.e. after the insertion of inserts or enclosures or the like, the protruding marginal section or lap 12 is trimmed off or cut away. The paper material loss which results from trimming off or cutting away such marginal section 12 is considerably less as compared to the conventional printed product illustrated in FIGS. 1 to 3, particularly in the case of printed products which contain many pages or sheets.

A possible method of producing the inventive printed product 7 illustrated in FIGS. 6 and 7 will now be explained hereinafter with reference to FIG. 8.

Three printed strands or webs or printed sheet lines 14, 15 and 16 originating from a printing station of a conventional rotary printing press, which is not shown in any particular detail, are fed in juxtaposition to turning or deflecting means 17 which also are of conventional construction. The information intended for the outermost printed sheet 8 is printed on the printed strand 14, the information intended for the central or intermediate printed sheet 8' is printed on the printed strand 15, and the information intended for the innermost printed sheet 8" is printed on the printed strand 16. The printed strands 14 and 15 have the same width and which has been designated by reference character B, while the printed strand 16 has a width designated by the reference character B' and which is greater than the width B of the printed strands 14 and 15 by the width of a marginal strip 18. The marginal strip 18 ultimately forms the marginal section or lap 12 of the innermost printed sheet 8" as will still be explained in greater detail hereinafter.

Each of the printed strands or webs or printed sheet lines 14, 15, 16 is guided over a respective turning or deflecting bar 19, 20, 21 of the turning or deflecting means 17. The printed strands 14, 15, 16 which are directed towards the turning or deflecting means 17 while in a juxtaposed relationship are now superposed in such a manner that the side or longitudinally extending edges 14*a*, 15*a* and 16*a* of the printed strands 14, 15, 16 are aligned or flush with one another. As will be recognized from FIG. 8, the printed strand 14 assumes the lowermost position, while the printed strand 16 is placed on top, so that one side 16' thereof is exposed. The topmost printed strand or web or printed sheet line 16 protrudes past the printed strands 14 and 15 which are positioned therebelow by means of the marginal strip 18 located at the side or longitudinally extending edge 16*b*.

The printed strands 14, 15 and 16 which have been superposed in such a manner now pass through a suitable cutting or trimming device 22 which is only schematically illustrated and may be of any known design. The printed strands 14, 15, 16 are then cut or severed by the cutting device or cutter unit 22 in a direction which extends at right angles or transversely to their side or longitudinally extending edges 14*a*, 15*a*, 16*a* and 14*b*, 15*b*, 16*b*. In FIG. 8 the cutting or trim line has been designated by reference numeral 23. The printed strands 14, 15, 16 are thus subdivided into individual packs or stacks of superposed printed sheets 8, 8' and 8" by means of the cutting or trimming device 22. Subsequently these packs or stacks are delivered to a suitable product folding apparatus 24 likewise of known construction and which has only been schematically indicated by phantom or dash-dotted lines. In the folding apparatus 24 the superposed printed sheets 8, 8' and 8" are conjointly folded along the fold line or fold 9 which also extends at right angles or at least transversely with respect to the direction of the longitudinally extending edges 14*a*, 15*a*, 16*a* and 14*b*, 15*b* and 16*b* of the printed strands 14, 15 16. The folded printed products 7 departing from the folding apparatus 24 are then lid out or delivered in the usual manner.

Figure 7:
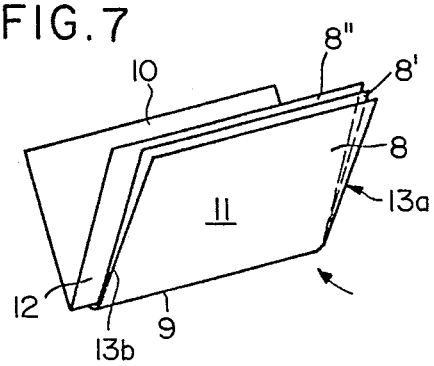
FIG. 7 is a perspective view of the printed product shown in FIG. 6 in a half-open state.

It will be recognized from the foregoing explanations that the printed products 7 illustrated in FIGS. 6 and 7 can be produced by means of a conventional rotary printing press without any extensive modifications. It is only necessary to take care that the one printed strand or web or printed sheet line 16 has a somewhat greater width than the remaining printed strands or webs or printed sheet lines 14 and 15.

It also should be understood that printed products can be produced in the same manner which contain only two or more than three folded printed sheets or signatures.

A second embodiment of the printed product according to the invention, designated by reference character 25, will now be described with reference to FIGS. 9 to 12.

The printed product 25 here also comprises three printed sheets or signatures 26, 26' and 26" which are tucked or placed one inside another and which are folded along a centrally arranged fold line or fold 27. Each of the printed sheets 26, 26' and 26" are subdivided by the fold line 27 so as to form two pages or sheet portions 28 and 29.

In contrast to the first exemplary embodiment illustrated in FIGS. 4 to 7, here the printed sheets or signatures 26, 26' and 26" all have the same dimensions. In particular this means that all of the three printed sheets or signatures 26, 26' and 26" have the same height H. The innermost printed sheet or signature 26", however, is here offset with respect to both of the other mutually overlying or covering printed sheets or signatures 26 and 26' by the amount a or a', respectively, in the direction of the fold line 9. As a consequence, the innermost printed sheet 26" now protrudes by means of a marginal section or lap 31 past or beyond a bottom edge 30 which extends transversely from the fold line 27. The innermost printed sheet or signature 26" is therefore set back or retracted from the opposite top edge 32 by the amount a'.

The printed product 25 is opened substantially in the same manner as the printed product 7 shown in FIGS. 6 and 7. The opening of the printed product 25 is effected by the action of any suitable opening device which acts upon the protruding marginal section or lap 31 of the innermost printed sheet or signature 26'. Since the protruding marginal section 31 forms a portion or integral part of the innermost printed sheet 26″ it is thus ensured that the printed product 25 is positively opened at the center of the printed product 25.

After completing the printed product 25 by stuffing inserts or enclosures, the protruding printed sheet or signature 26″ is now again pushed back in the direction of the fold line 27 to such an extent that the edges thereof are flush with those of the other printed sheets or signatures 26 and 26′. Since no protruding marginal section or lap is now present in the finished product and since no such protruding marginal section or lap has to be trimmed off or cut away, a loss of paper material is here totally avoided by using a printed product 25 as shown in FIGS. 9 to 12.

One possibility for producing a printed product 25 as depicted in FIGS. 11 and 12 will now be explained with reference to FIG. 13 and which illustration extensively corresponds to FIG. 8.

Three printed strands or webs or printed sheet lines 33, 34 and 35 are fed in juxtaposed relationship from a not-illustrated printing station of a rotary printing press to turning or deflecting means 36 which comprise turning or deflecting bars 37, 38 and 39, each of which is operatively associated with a respective one of these printed strands 33, 34 and 35. All of the three printed strands 33, 34 and 35 have the same width B. The information intended for the outermost printed sheet 26 of the printed product 25 is printed on the printed strand 33, while the information intended for the central or intermediate printed sheet 26′ and the information intended for the innermost printed sheet 26″ are printed on the printed strands 34 and 35, respectively. These printed strands 33, 34 and 35 run over the respective turning or deflecting bars 37, 38 and 39 and are thereby arranged in such a relative position to one another that they are no longer disposed in a juxtaposed relationship but in a superposed relationship. As will be evident from FIG. 13, the printed strand or web or printed sheet line 33 forms the lowermost printed strand and the printed strand or web or printed sheet line 35 forms the uppermost printed strand defining an exposed side or page 35′. The turning or deflecting bar 39 is offset relative to the two other turning or deflecting bars 37 and 38 by an amount a″ in the direction of the arrow A of FIG. 13 and, therefore, the uppermost printed strand 35 is shifted or laterally offset with respect to the two other printed strands 33 and 34 by a corresponding amount a. While the longitudinal edges 33*a* and 34*a* and the longitudinal edges 33*b* and 34*b* of the printed strands 33 and 34, respectively, are in mutual alignment, the longitudinal edges 35*a* and 35*b* of the printed strand 35 are offset from the corresponding longitudinal edges of the printed strands 33 and 34 by the amount a and a′, respectively. The printed strand 35 thus now protrudes past the other two printed strands 33 and 34 by means of a marginal strip 40.

The printed strands 33, 34 and 35 which are superposed in the manner just described are now delivered to a suitable cutting or trimming device 41 of conventional construction which is therefore here only schematically illustrated. At the cutting device 41 the strands 33, 34 and 35 are conjointly cut along a cutting or trim line 42 which is indicated by dashed lines and which extends at right angles or transversely relative to the longitudinal edges 33*a*, 34*a*, 35*a* and 33*b*, 34*b*, 35*b* of the respective printed strands or webs or printed sheet lines 33, 34 and 35. By transversely cutting or severing the endless or continuous printed strands 33, 34 and 35 in this manner, packs or stacks of superposed printed sheets 26, 26′ and 26″ are formed. The packs or stacks of the printed sheets 26, 26′ and 26″ are subsequently delivered to a suitable folding apparatus 43 which likewise is of known construction and which is indicated by phantom or dash-dotted lines. In the folding apparatus 43 the superposed printed sheets 26, 26′, 26″ are folded along the fold line 27 which also extends at right angles or transversely relative to the direction of the longitudinal edges 33*a*, 34*a*, 35*a* and 33*b*, 34*b*, 35*b* of the respective printed strands 33, 34, 35. The printed products 25 then leave the folding apparatus 43 and are laid out or delivered in known manner and now correspond to the printed product 25 shown in FIGS. 11 and 12.

It will be understood that printed products 25 containing only two printed sheets or more than three printed sheets also can be produced in the manner described with reference to FIG. 13.

Figure 8:
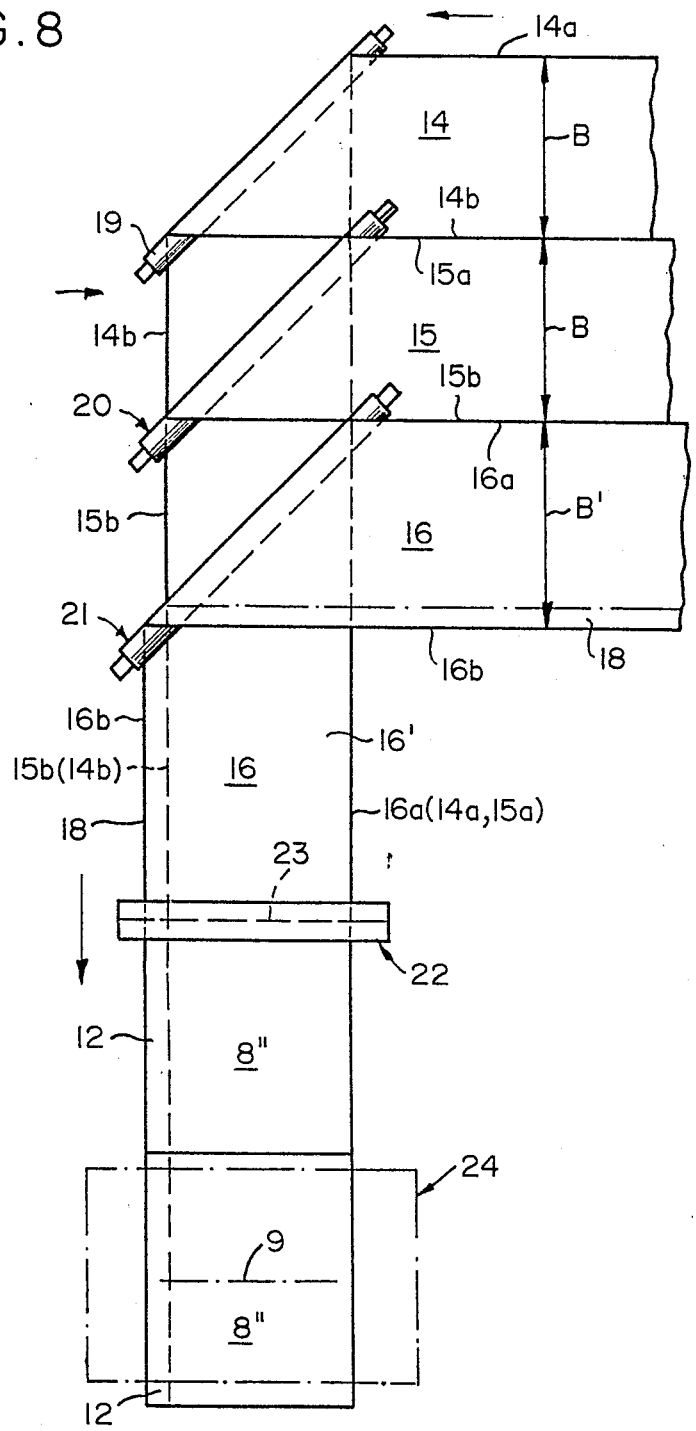
FIG. 8 is a schematic top plan view of an apparatus for producing the printed product shown in FIGS. 6 and 7.
Figure 13:
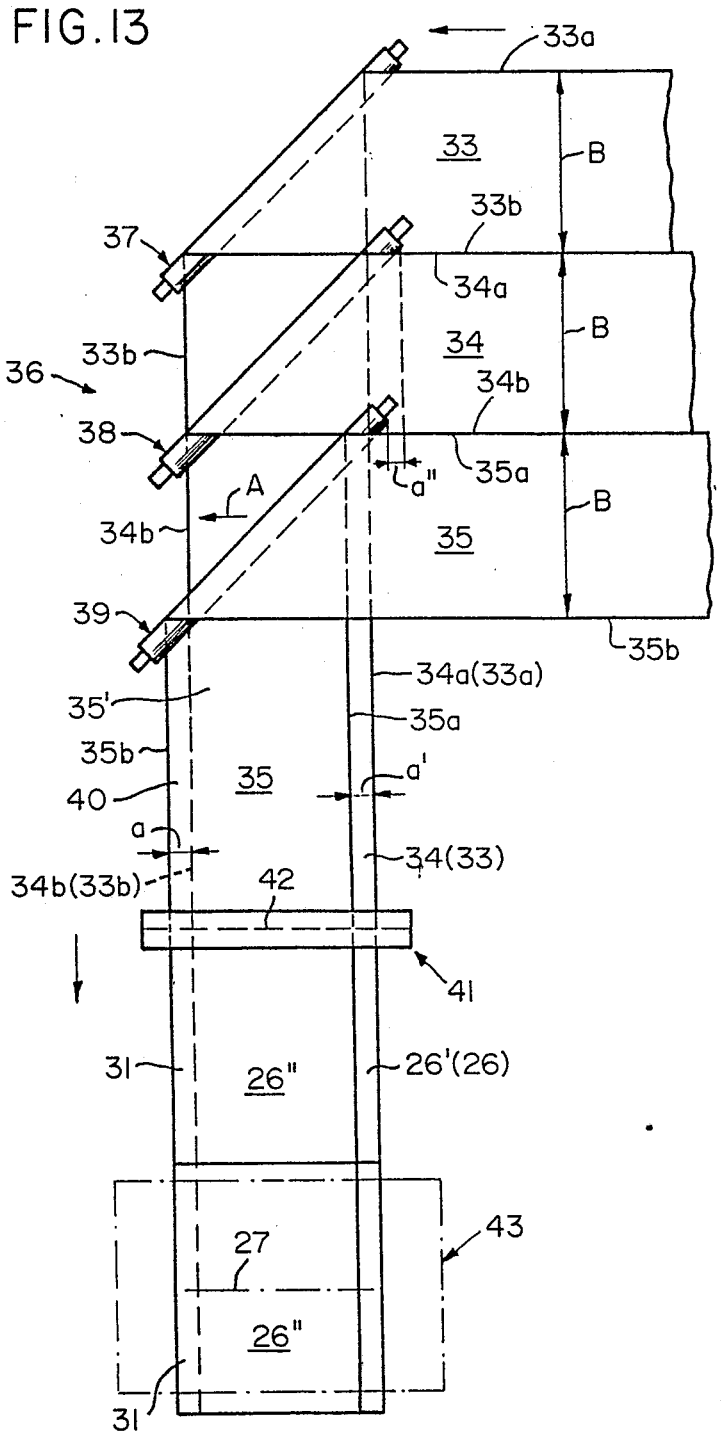
FIG. 13 is a schematic top plan view of an apparatus for producing the printed product shown in FIGS. 11 and 12.

It is also conceivable to join or collate the strands or sheet lines after or subsequent to the turning or deflecting means 17 or 36, respectively, in such a manner as to be arranged one after the other or in a tandem fashion in a direction which extends at right angles relative to a plane defined by the printed strands instead of being positioned in superposed fashion as shown in FIGS. 8 and 13. However, care will have to be taken in each case to ensure that the printed strand 16 or 35 carrying the information of the innermost printed sheet or signature 8″ or 26″, respectively, assumes the lowermost or uppermost and foremost or rearmost position, respectively, so that a respective edge or marginal section 16′ or 35′ of such printed strand is exposed.

In the herein disclosed two embodiments of the inventive printed product designated by reference numerals 7 and 25, the respective innermost printed sheet or signature 8″ and 26″ protrudes past or beyond the other printed sheets or signatures at respective edges 13*b* and 30 which extend transversely from the respective fold edge 9 and 27. However, it is also possible to have the innermost printed sheet or signature protrude beyond the edge which extends opposite and parallel to the related fold edge 9 and 27.

In such a design of the printed product analogous to the one illustrated by FIGS. 4 to 7, if the innermost printed sheet is structured to be wider than the remaining printed sheets by the amount of a protruding marginal strip in a direction which extends transversely relative to the spine or fold line, then such a printed product can be produced in substantially the manner as described with reference to FIG. 8. However, the printed sheets will not be folded transversely relative to the protruding marginal section as shown in FIG. 8, but parallel thereto. In this regard attention is invited to FIGS. 14 to 17.

The innermost printed sheet or signature also can be made to protrude on the edge which is opposite to the fold edge in a manner similar to the printed product illustrated by FIGS. 11 and 12 by offsetting the innermost printed sheet relative to the remaining printed sheets in a direction which extends transversely relative to the fold line. In such a design and arrangement, the fold line of the innermost printed sheet or signature extends from the fold lines of the remaining printed sheets or signature at a distance which corresponds to the amount of the offset. In this connection attention is directed to FIGS. 18 to 20. Such design of the printed product has the advantage that the offset innermost printed sheet can be positively pushed back again into the correct position when the insert or enclosure is inserted or stuffed therein.

While there are shown and described present preferred embodiments of the invention, it is to be distinctly understood that the invention is not limited thereto, but may be otherwise variously embodied and practiced within the scope of the following claims. Accordingly:

What I claim is:

1. A method of producing a multi-sheet folded printed product, comprising the steps of:

forming at least two printed product strands such that each one of said strands defines a predetermined longitudinal edge;

superposing said at least two printed product strands such that one printed product strand thereof provided with information intended for an innermost printed sheet in an intermediate folded printed product is positioned such that said longitudinal edge of said one printed product strand laterally protrudes past the other printed product strand;

cutting said superposed at least two printed product strands in a direction extending transversely relative to said longitudinal edges thereof conjointly in order to form an intermediate product comprising superposed printed sheets with their cut edges being in alignment; and conjointly folding said superposed printed sheets such that one printed sheet formed from said one printed product strand forms said innermost printed sheet.

2. The method as defined in claim 1, wherein:

said step of cutting said superposed at least two printed product strands entails cutting said superposed at least two printed product strands in a direction which extends substantially perpendicular relative to said longitudinal edges in order to form said printed sheets.

3. The method as defined in claim 1, further including the steps of:

forming said at least two printed product strands such that said longitudinal edges of said at least two printed product strands extend substantially parallel to each other; and said step of conjointly folding said superposed printed sheets entails conjointly folding said superposed printed sheets formed from said at least two printed product strands in a direction which extends transversely relative to said longitudinal edges.

4. The method as defined in claim 3, wherein:

said step of conjointly folding said superposed printed sheets entails conjointly folding said superposed printed sheets formed from said at least two printed product strands in a direction which extends essentially perpendicular relative to said longitudinal edges.

5. The method as defined in claim 1, wherein:

said step of conjointly folding said superposed printed sheets entails conjointly folding said superposed printed sheets along a substantially central line thereof.

6. The method as defined in claim 1, further including the steps of:

forming more than two said printed product strands; and superposing said more than two printed product strands so as to define one laterally offset printed product strand and positioning said one laterally offset printed product strand such as to define an exposed side.

7. The method as defined in claim 1, further including the steps of:

providing one printed product strand with a greater width than the other printed product strand; and superposing said at least two printed product strands such that said one printed product strand with said greater width is provided with the information intended for said innermost printed sheet in said final folded printed product.

8. The method as defined in claim 7, further including the step of:

superposing said at least two printed product strands such that other predetermined ones of said longitudinal edges of said at least two printed product strands located opposite to said laterally protruding one longitudinal edge of said one printed product strand are substantially in alignment with one another.

9. The method as defined in claim 1, further including the step of:

superposing said at least two printed product strands such that said one printed product strand provided with the information intended for said innermost printed sheet in said intermediate folded printed product is positioned as to be laterally offset from the other one of said at least two printed products strands.

10. The method as defined in claim 9, further including the step of:

forming said at least two printed product strands so as to have substantially the same width.

11. The method as defined in claim 1, further including the step of:

ultimately processing the folded printed sheets such that each of the folded printed sheets possess essentially the same dimensions and are substantially squared up with respect to one another in a final product containing at least said folded printed sheets.

12. The method of producing a multi-sheet folded printed product, comprising the steps of:

forming at least two printed product strands such that each one of said strands defines a predetermined longitudinal edge;

superposing said at least two printed product strands such that one printed product strand thereof provided with information intended for an innermost printed sheet in an intermediate folded printed product is positioned such that at least said longitudinal edge of said one printed product strand laterally protrudes past the other printed product strand;

cutting said superposed at least two printed product strands in a predetermined direction relative to said longitudinal edges thereof conjointly in order to form an intermediate product comprising superposed printed sheets with their cut edges being in alignment; and conjointly folding said superposed printed sheets such that one printed sheet formed from said one printed product strand forms said innermost printed sheet.

13. The method as defined in claim 12, wherein:

said step of cutting said superposed at least two printed product strands in a predetermined direction relative to said longitudinal edges thereof entails cutting said superposed at least two printed product sheets sheets in a direction extending substantially transversely to said longitudinal edges.

14. The method as defined in claim 12, wherein:

said step of cutting said superposed at least two printed product strands in a predetermined direction relative to said longitudinal edges thereof entails cutting said superposed at least two printed product sheets sheets in a direction extending substantially parallel to said longitudinal edges.

15. The method as defined in claim 12, further including the step of:

ultimately processing the folded printed sheets such that each of the folded printed sheets possess essentially the same dimensions and are substantially squared up with respect to one another in a final product containing at least said folded printed sheets.

16. A method of producing a multi-sheet folded printed product, comprising the steps of:

forming at least two printed product strands such that each one of said strands defines a predetermined longitudinal edge;

superposing said at least two printed product strands such that one printed product strand thereof provided with information intended for an innermost printed sheet in an intermediate folded printed product is positioned such that at least said longitudinal edge of said one printed product strand assumes a predetermined position with respect to the longitudinal edge of the other printed product strand;

cutting said superposed at least two printed product strands in a predetermined direction relative to said longitudinal edges thereof conjointly in order to form an intermediate product comprising superposed printed sheets with their cut edges being in alignment;

conjointly folding said superposed printed sheets such that one printed sheet formed from said one printed product strand forms said innermost printed sheet; and positioning said innermost printed sheet such that a fold line thereof is offset with respect to each fold line of said other printed product sheets and with said innermost printed product sheet protruding at an edge thereof located opposite its fold line beyond edges of the other printed product sheets located opposite their fold lines.

* * * * *